United States Patent [19]

Blume, Jr. et al.

[11] Patent Number: 4,873,504

[45] Date of Patent: Oct. 10, 1989

[54] BONDED HIGH ENERGY RARE EARTH PERMANENT MAGNETS

[75] Inventors: Walter S. Blume, Jr., Cincinnati; Walter S. Blume, III, Amelia, both of Ohio

[73] Assignee: The Electrodyne Company, Inc., Ohio

[21] Appl. No.: 18,626

[22] Filed: Feb. 25, 1987

[51] Int. Cl.[4] ..... H01F 7/02

[52] U.S. Cl. ..... 335/303; 264/108; 252/62.54

[58] Field of Search ..... 335/302, 303; 264/108; 252/62.53, 62.54

[56] References Cited

U.S. PATENT DOCUMENTS

| | | | |
|---|---|---|---|
| 2,999,275 | 9/1961 | Blume, Jr. . | |
| 3,141,050 | 7/1964 | Blume, Jr. . | |
| 3,246,060 | 4/1966 | Blume, Jr. . | |
| 4,496,395 | 1/1985 | Croat . | |
| 4,689,163 | 8/1987 | Yamashita et al. | 335/302 X |
| 4,702,852 | 10/1987 | Sakauchi et al. | 335/302 X |

OTHER PUBLICATIONS

Article by R. W. Lee, E. G. Brewer and N. A. Schaffel titled "Processing of Neodymium-Iron-Boron Melt-Spun Ribbons to Fully Dense Magnets"—IEEE Transactions on Magnetics, vol. Mag. 21, No. 5, Sep. 1985.

Brochure entitled "Magnetquench MQ Powder" by Magnetic Products, Delco Remy Div. of General Motors.

*Primary Examiner*—George Harris

*Attorney, Agent, or Firm*—Wood, Herron & Evans

[57] ABSTRACT

A permanently magnetizable composite is made from rare earth permanent magnet material by incorporating coarse particles of the material into a workable binder at a gradual rate such that sparking and combustion are avoided, until the particles are coated with or embedded in the binder, and then working the mixture under shearing forces sufficient to break up the particles in situ, thereby forming much finer particles directly within the binder. Extremely high particle packing fractions can be obtained in this manner, yet the residual induction of even an isotropic composite substantially exceeds the maximum that would be expected for a magnet having that packing fraction.

23 Claims, 1 Drawing Sheet

BONDED HIGH ENERGY RARE EARTH PERMANENT MAGNETS

FIELD OF THE INVENTION

This invention relates to composite permanent magnets and permanently magnetizable magnet materials, wherein discrete particles of permanent magnet material, preferably of the rare earth type, are bonded together by a non-magnetic matrix.

BACKGROUND

Many permanent magnet materials are of such hard, brittle or refractory nature that, if used in solid or sintered form they are easily broken in handling. Moreover, they are very difficult to work, cut and shape. This is true, for example, of the "Alnico" alloys, the barium ferrites, and the rare earth class of permanent magnet materials. In order to overcome this problem, the bulk magnet material is often subdivided into fine particles which are then bonded together in a non-magnetic matrix. For example, it is known to produce edge-cuttable magnets of such materials by mixing and bonding particles of the magnet material with a workable or cuttable binder such as rubber or vinyl, and then forming the resulting mixture into sheets or strips as by extruding, rolling, or injection molding.

However, such subdivision and bonding is accompanied by a sacrifice of magnetic properties. In general, the "dilution" of the starting permanent magnet material by the magnetically inactive binder, or the presence of non-magnetic spaces of any type between the particles, materially reduces the ultimate magnetic properties of the composite in comparison to those exhibited by the undivided magnet material.

Because magnetic properties are so strongly affected by the relative amount by volume of magnet particles in the composite, the volumetric proportion of magnet particles (not including voids in the composite) is an important parameter of any composite magnet. This proportion is commonly referred to as the particle "packing fraction." It is the ratio of the specific gravity of the composite, adjusted for the contribution of the non-magnetic binder therein, to the specific gravity of the individual magnetic particles (i.e., the undivided material from which the particles are derived).

It is known in the art that the intended packing fraction $P_{fi}$ of a given composite mixture can be calculated as follows:

$$P_{fi} = \frac{W_m d_b}{(W_b d_m) + (W_m d_b)} \quad (1)$$

where $d_m$ and $d_b$ respectively are the specific gravities, and $W_m$ and $W_b$ respectively the weights, of the magnet particles and binder present in the mixture.

If the mixture does not pack as tightly as expected (which is often the case), the actual packing fraction $P_f$, as distinguished from the intended packing fraction $P_{fi}$, can be calculated as follows:

$$P_f = \frac{(W_m d_b) + (W_b d_m)}{(W_t d_m d_b)} \times d_c \times P_{fi} \quad (2)$$

where $d_c$ is the measured specific gravity of the composite and $W_t$ is the sum weight total of the binder and particles. Expressed in more abbreviated terms, this equation becomes, $$P_f = (d_{ci}/d_c) \times P_{fi}$$

where $d_{ci}$ is the computed specific gravity of the composite, calculated on the basis that the mixture has been packed to its fullest extent.

The normal demagnetization curve of an ideal permanent magnet material has a linear slope (as opposed to being hyperbolic) which is equal to unity; the maximum energy product of a permanent magnet has its highest theoretical value if the slope is unity. As a practical matter, the barium ferrite materials were the first commercial magnets to approach this characteristic. Subsequently the same capability was demonstrated by the rare earth samarium-cobalt magnets, and more recently by the neodymium-iron-boron type of magnets.

As stated above, the particle packing fraction $P_f$ of a given composite strongly affects the magnetic property $B_{rc}$ (i.e., the residual induction) of the composite. Specifically, $$B_{rc} = \frac{P_f}{(1 - P_f)(S - 1) + 1} \times B_r \quad (3)$$

where S is the slope $B_r/H_c$, and $B_r$ is the residual induction of the starting material. (All the foregoing equations are commonly used in connection with the analysis and production of composite magnets.)

Thus, if the slope S of the normal demagnetization curve is unity, the residual induction ($B_{rc}$) of the composite or assemblage of particles varies in direct proportion to the particle packing fraction $P_f$. For example, if the magnet material has a demagnetization curve with a slope of unity, a bonded magnet of that material having a particle packing fraction of, say, 0.5 will have a residual induction which at best is half that of the starting bulk magnet material. (If the raw material has a straight line slope S greater than unity, the $B_{rc}$ of a composite will be less than directly proportional to the packing fraction.) Thus, even though the composite material may be much more suitable mechanically than the solid material, the usual trade-off is that the magnetic property of residual induction (and hence the maximum energy product) is materially reduced. (These criteria apply only if the composite and the starting material are equally isotropic or anisotropic. If alignment (anisotropy) is achieved in the composite, whereas the starting material was isotropic, the alignment must be taken into account).

Thus, in order to provide bonded magnets having the highest available magnetic properties for a given type of magnet material, it is desirable to establish the highest possible packing fraction, that is, to incorporate the greatest possible proportion by volume of the magnet material in the binder.

Apart from considerations of packing fraction, for most particulate magnet materials the best magnetic properties are obtained at certain specific, very small particle sizes; magnetic properties often improve as average particle size decreases. In the case of barium ferrite, for example, the best properties are obtained when the average particle size is of substantially single domain size with a diameter or maximum dimension of the order of roughly 0.5–1.0 micron. For materials of the rare earth type, with which this invention is especially concerned, the best properties are obtained with single domain size particles which are even smaller, about 0.1–0.2 micron.

However, it is often very difficult to obtain a high packing fraction where very small particles are employed. The total surface area of a given weight of particles increases enormously as average particle size diminishes; it is increasingly difficult for a given volume of binder to "wet" the surface of the particles, as particle size diminishes, so as to form a homogeneous and cohesive mixture. Thus, it is observed that, as particles are added to a binder for mixing therewith, after a certain loading is reached the mixture tends increasingly to reject further particles. The mixture becomes "dry", crumbly, and loses adherence to further particles. While the proportion of magnetic particles may exceed 90% by weight because the densities of most magnet materials are so much greater than those of most binders, it is difficult to obtain a packing fraction—which reflects a significant volume, rather than a deceptively high weight—above a value of about 0.6 unless large, coarse particles are used. However, such large particles do not provide the benefits derived from the use of the smaller particles. Furthermore, large particles interlock to an extent that harms homogeneity and mechanical flexibility.

Permanent magnet materials of the rare earth type are well known and possess unusually high energy products in isotropic, undivided form, of the order of 12 megaGaussOersted (MGOe) and more. These are customarily produced by powder metallurgy and sintering techniques. As already noted, however, such materials are hard, brittle and refractory, and are relatively difficult to handle, work and form. While it is known to crush such material and to immobilize the crushed particles with a binder such as epoxy, the particles are relatively coarse and do not display magnetic properties approaching those of the much finer single domain size particles (about 0.1–0.2 microns). With many materials the single domain particles are highly anisotropic and, if aligned during the forming stage, an anisotropic rather than an isotropic product will result. For reasons described below, it is excessively difficult to obtain high packing fractions in polymer bonded magnets using particles of rare earth materials ground to that extreme degree of fineness. Indeed, below even 50 microns particle size, the easily oxidized metal particles tend to become more pyrophoric and prone to combust spontaneously if exposed to air even briefly. It has therefore been necessary as a practical matter to use large anisotropic or isotropic particles in bonded rare earth magnets.

Not only are extremely fine particles of such materials pyrophoric, even coarse particles of rare earth materials tend to react adversely with and degrade in and with a wide range of polymer binder materials. The precise chemical nature of the degradation-causing reactions are not well understood. Sometimes the reactions are very exothermic. If for example particles of the neodymium-iron-boron (NdFeB) type of rare earth magnet materials are incorporated into an uncured synthetic polyisoprene rubber (which is a very stable binder for bonded barium ferrite magnets, as are most other commercial polymers), the mixture becomes abnormally gooey in compounding and remains so for days, then eventually becomes embrittled and useless. The rare earth starting materials have spontaneously reacted chemically with numerous other polymer materials. Nancar 1041, Estane 58309-022 and Hytrel 4056 are examples of specific commercially available polymers of the nitrile, polyether, and polyester elastomer families respectively, which tend to initiate sudden pyrophoric and/or exothermic reaction with coarse NdFeB particles. With some polymers reaction occurs very suddenly; and the mixtures have often decomposed with accompanying red heat upon addition of a small quantity of the rare earth powder. This can occur even though the compounding temperature (prior to such reaction) is held at a temperature of about 150° F. So far as is known, it has not heretofore been possible as a practical matter to produce polymer bonded rare earth magnets exhibiting high magnetic values with long term stability. Such magnets have been extremely limited in terms of commercial use. The use of single domain particles makes the problem even more severe.

Thus there has been a need for a stable, bonded permanent magnet (or permanently magnetizable material), especially of the rare earth type, which will have a residual induction substantially higher than those available with present bonded magnets of the same magnet material; and there has been a need for a process of incorporating a very high proportion by volume of extremely fine particles of rare earth magnet material into a binder to produce such magnets.

THE PRIOR ART

Blume U.S. Pat. No. 2,999,275, issued Sept. 12, 1961, titled "Mechanical Orientation of Magnetically Anisotropic Particles", teaches a process wherein anisotropic, substantially single domain size particles of a permanent magnet material are mixed with a binder and the mixture is milled, calendared or extruded into sheets. That process depends upon the use of particles having a geometric shape wherein the preferred magnetic axes of the particles bear a consistent or unique relationship to the geometric shapes. In the case of single domain size barium ferrite particles, the particles tend to be plate-like and the preferred magnetic axes of the particle tend to be perpendicular to the planes of the particles. The magnetic axes of such anisotropic particles are oriented by mechanically orienting the geometric axes of the particles. The process is carried out by mixing the particles with a binder such as rubber or plastic and working the mixture between rolls or by extrusion, as a result of which the plate-like particles are oriented by the shearing forces exerted on them in rolling or extrusion. The domain size particles utilized are extremely fine, are not pyrophoric and do not chemically react with the binder material.

Blume U.S. Pat. No. 3,141,050, titled "Mechanical Orientation of Magnetically Anisotropic Particles", issued July 14, 1964, teaches mixing anisotropic magnetic particles, again of the barium ferrite type, with uncured rubber and other binders in a Banberry or intensive mixer to form a mixture, then granulating or pulverizing the mixture to form granules of the mixture, and finally sheeting the granules, whereby orientation is again obtained mechanically.

Blume U.S. Pat. No. 3,246,060, titled "Method of Making Machinable High Energy Permanent Magnets," issued Apr. 12, 1966, teaches a process wherein anisotropic particles are first aligned magnetically and are then compacted with a small amount of temporary binder, fired to drive off the binder, raised to sub-sintering temperature to enhance alignment, then impregnated with a final binder without disturbing the alignment, to form an edge cuttable, aligned material.

The manufacture of permanent magnet materials of the rare earth—iron class is disclosed in Croat U.S. Pat. No. 4,496,395, titled "High Coercivity Rare Earth Iron Magnets," issued Jan. 29, 1985. That patent is particularly directed to NdFeB magnets, which have exceptionally good properties.

The manufacture of bonded rare earth-iron magnets is disclosed in "Processing of Neodymium-Iron-Boron Melt-Spun Ribbons to Fully Dense Magnets" by R. W. Lee, E. G. Brewer and N. A. Schaffel, *IEEE Transactions on Magnetics,* Volume Mag. 21, No. 5, September 1985, pages 1958 ff. According to that article, the ribbons are magnetically isotropic and have a fine grain structure, the grains of which are of the order of single domain size. Isotropic bonded magnets are produced by crushing ribbons of solid NdFeB, blending the crushed particles with an epoxy binder to adhere them, and packing at pressures of about 100,000 psi to a packing fraction of about 0.85. This limits the technique to the production of composite magnets of relatively small size; in order to produce magnets having an area of more than a few square inches, enormously powerful and expensive presses would be required. The product which is brittle, comprises relatively coarse particles, and is said to have an energy product of about 9 mGOe. Also taught are unbonded magnets made by pressing NdFeB particles in a protective atmosphere, under red heat and high pressure to "full density", i.e., 7.55 gms/cc. The resultant solid is refractory and easily broken.

European patent application No. 84301453.1, filed Mar. 6, 1984 and titled "Bonded Rare Earth-Iron Magnets" discloses permanent bonded magnets of very finely crystalline melt spun rare earth—iron alloy. These are formed by compacting particles of the alloys into compacts which are then fixed in shape by binding agents and then magnetized. The products are isotropic.

BRIEF DESCRIPTION OF THE INVENTION

In one aspect, this invention is directed to a process of preparing bonded magnets, preferably but not necessarily of the rare earth type, which overcomes the difficulties presented by the use of pyrophoric, ultrafine, exothermic, and/or binder-reactive particles of the magnet material and which at the same time provides a residual induction better than has previously been available for a composition of that material, at a given packing fraction, and a concomitantly high energy product. In another aspect, the invention is directed to composite magnets of unexpectedly high magnetic properties which are flexible, not limited as to size, and which can be formed without need for a protective atmosphere. These products can, in fact, be produced with consistent ease over a wide range of sizes, from miniature magnets all the way up to sheets several square feet in area.

Unlike prior art processes, in this process the starting magnet particles are relatively coarse and are reduced to a much finer size, after they have first been incorporated into the binder. That is, they are comminuted in situ in the binder rather than being ground or reduced first to a desired state of fineness, prior to incorporation to the binder. The reduction in particle size is so pronounced that it is apparent even to the naked eye.

The adversely reactive properties of the mixture are found to improve once the particles are incorporated within the compatible binder. Furthermore, we have found that the mechanical properties are improved greatly due to the in situ particle size reduction. We have further discovered, much to our surprise, that the magnetic properties can be improved well beyond the expected maximum limit, by the in situ particle size reduction. So far as we are aware, substantial or significant reduction of particle size in a binder has not been discovered, accomplished or used as a way of improving mechanical and isotropic magnet properties of a composite magnet.

Apart from the improved mechanical properties it also has been discovered that, perhaps paradoxically because of this in situ reduction in size, it is possible to obtain exceptionally high packing fractions, higher than previously obtainable for ultrafine particles of any known type, except by sintering processes. The key is starting with coarse particles of these materials.

The resulting composite displays magnetic properties better than those which would be expected for its packing fraction. So far as is known, we are the first to discover this phenomena. The particles of the permanent magnet starting material can be in magnetically isotropic form; that is, they need not be magnetically anisotropic and thus would not be expected to be oriented to provide anisotropic magnetic properties. Indeed, so far as we have been able to determine to date, the resulting product is not anisotropic. The relative difference in $B_r$ of the resulting composite, measured along the three cubic axes, does not yield a fraction more than about 0.0017 in excess of isotropic properties. This is so insignificant as to be within measuring instrument error and is meaningless in a practical sense.

The starting particles of the magnet material may be quite coarse, far larger than the single domain size for that magnet material. In the case of NdFeB material, the starting particles are, on the average, many times larger than the 0.1–0.2 micron single domain size. Indeed, in the preferred practice more than 85% of the starting particles is in the range of 44 to 420 microns in size, with a high portion of these in the large end of the range.

The proportion of magnetic particles is not critical to obtain some of the benefits of the invention, but the best properties are obtained at the highest packing fractions. Surprisingly, we have found that packing fractions at least as high as 0.8 can be attained, and the magnet end products can still be flexible. The extent of the flexibility realized is remarkable, even at packing fractions of about 0.6, especially in view of having started with such coarse particles.

In carrying out the process with a rare earth material, the coarse starting particles are sprinkled (or, if they are magnetized, pinches are gradually added) onto a workable non-magnetic binder to form a mixture. Mixing is carried out much more slowly than in conventional polymer compounding procedures, wherein particles are normally added in bulk amounts. It is important this "imbedding stage", wherein the particles are still in the process of being wetted or coated with the binder, does not proceed so rapidly as to cause friction between the unprotected or bare tumbling, agitated particles at the nip of the rolls, which would lead to sparking due to their flint-like character. Even a single spark can initiate a pyrophoric chain reaction throughout the uncoated particles.

Although many types of binders react exothermically after incorporation of incompatible magnetic particles, we have found that flexible or elastomeric-like copolymers of the ethylene-vinyl acetate and vinyl acetate-ethylene class are not reactive with NdFeB particles under the processing conditions of this invention and will gradually accept very high proportions of such particles without sparking once the particles are within the protection of the compatible binder. After achieving this condition, the mixture may then be worked much more vigorously, within the working limits of the specific polymer. Ethylene-vinyl acetate, vinyl acetate-ethylene copolymers and silicon elastomers are the best materials for this purpose which have been identified to date. The epoxies, nylon, and certain polyethylene polymers have also been found not to react with NdFeB particles, at least at low temperatures, but such materials are processed by injection or compression molding and the end products are rigid. However, these materials can be blended with ethylene-vinyl acetate, vinyl acetate-ethylene copolymers, and silicon elastomers to produce flexible products. Silicon elastomers, even though they have poor green strength in the unvulcanized state, can be reinforced and used to obtain satisfactory mechanical properties and to materially enhance the environmental aging properties of the composites. Other binder materials of satisfactory characteristics can probably be found among the tremendous variety of polymers available today, given the teachings of the invention.

The selected polymer is first bonded on one of the rolls of a two-roll mill. The initial mixing can be carried out by sprinkling the particles slowly onto the bank formed at the nip of the rolls. Packing fractions of 0.60 or higher are preferred. Mixing can also be achieved in an intensive mixer such as a Banberry, but care must be taken to avoid excessive exotherm which could lead to unpredicted or hazardous reactions due to the intensity of mixing, ram pressure, shocks, rapid build-up of heat, rapid oxidation and chemical reactions. An inert atmospheric blanket is advisable, at least in early evaluation.

Once the particles have been incorporated and "wetted" by the binder, the mixture of binder and the coarse magnet particles in it is then subjected to more extensive working under shearing forces of such intensity that the average size of the magnet particles is substantially reduced within the binder.

The reduction of particle size can be safely achieved in situ in the binder by a process of sheeting following the mixing procedure. This avoids the severe difficulty of starting with particles which are so fine as to be pyrophoric or exothermic in air; yet the higher loadings peculiar to the use of coarse particles are not adversely affected by the size reduction in situ. Once the particles are coated by the inactive binder, problems of particle reaction with ambient atmosphere are eliminated. The particles are "coated" with binder while they are so large as not to be pyrophoric; thereafter, they are reduced to small sizes—preferably to the maximum degree that can be achieved by working the particles, e.g., to less than half the average size of the starting particles—under the protection of the binder, and they no longer burn or oxidize nearly so easily.

It has further been found that the danger of forming an explosive air suspension of such particles can be virtually eliminated by magnetizing the particles, prior to incorporation in the binder. This causes the particles to hang together as a "sludge"; dispersion of single particles in air is minimized. However, this does not prevent the possibility of sparking by adding the magnetized particles to a mix too rapidly, or dangerous chemical reaction with an improper binder.

The particle size reduction working step includes steps of progressively reducing the thickness of the mixture while simultaneously increasing its area in a series of sheeting steps, to form a sheet. The sheets are stacked and reworked to thin sheets; the process is repeated preferably at least 9 or more times until the desired proportion of particles has been added and the sheets are uniform, homogeneous, and fine grained. Desired magnet shapes are formed from the final sheet and are magnetized.

Most surprisingly, the resulting magnets have a residual induction $B_r$ which exceeds by at least 5% the value predicted by theory, as described above. The reason for this unexpectedly high value is not known; so far as we have been able to determine it cannot be accounted for by magnetic anisotropy. It appears to be the result of some change in the character of the magnet particles themselves which accompanies the size reduction in the working process.

DETAILED DESCRIPTION OF PREFERRED EMBODIMENT

EXAMPLE 1

In a preferred embodiment of the process of this invention, bonded rare earth magnets are prepared from a rapidly quenched neodymium-iron-boron permanent magnet powder as the starting material. The presently preferred starting material is that which is sold by the Delco Remy Division of General Motors Corporation under the trademark "Magnequench." The powdered form of this material is sold as "MQ Powder." The specific gravity of the individual, particles is 7.55, the slope of the normal curve of the powder is 1.177. Such curves are by practice supplied by the manufacturer Delco to the customer for each lot shipped. The residual induction ($B_r$) of each particle is 7,620 gauss. The chemical composition of the material is given as $Nd_2Fe_{14}B$. The particle size is specified as follows:

Greater than 420 microns, less than 0.1% by wt.

Less than 44 microns, less than 15.0% by wt.

(For reference, 420 microns is about 0.0168 inch, i.e., larger than 1/64 inch; 44 microns is about 0.0017 inch.)

The material has a Rockwell C hardness of 60.

Figure 1:
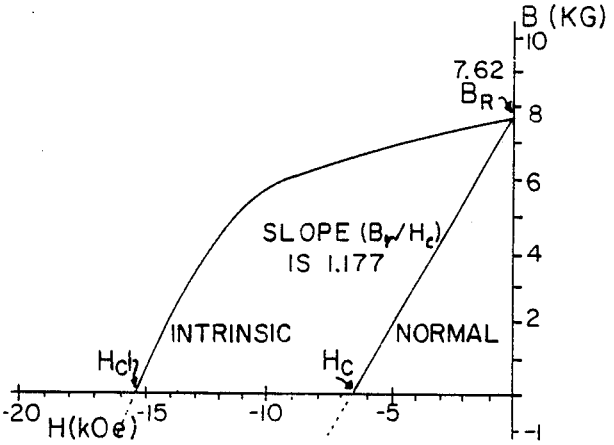
FIG. 1 is a graph showing the intrinsic and normal demagnetization curves of the preferred type of starting powder, as supplied by the manufacturer.

FIG. 1 illustrates the properties of the powder. The powder was tested by the manufacturer with the use of a vibrating sample magnetometer. This plots the demagnetization curve of the particles as if each was an independent magnet; the result of this procedure is entirely independent of the packing fraction or dilution due to any space between or about the particles of the powder used. The result is the same as if each respective particle was measured separately in the conventional manner for bulk magnets, and as if the powder had been packed to its full density of 7.55 gms./cc.

The material safety data sheet supplied by the manufacturer notes that a 200 mesh size powder presents "a weak explosive hazard when suspended in air with ignition at 959° C.," and further states that fine powder may ignite at room temperature in air. It is stated that the powder will probably react with water and release hydrogen slowly. The data sheet even warns against using a $CO_2$ extinguisher to put out the ignited particles; paradoxically, $CO_2$ may aid combustion of the particles.

While the MQ powder (i.e., rapidly quenched neodymium-iron-boron alloy) is the presently preferred starting material, it is contemplated that other rare earth permanent magnet materials can be used, including but not limited to neodymium-iron.

The particulate material is mixed with a binder which is chemically and magnetically inert with respect to it. As previously stated, many types of binders which heretofore have been used in bonded fine particle magnets are completely unsuitable for neodymium-iron-boron composite rare earth magnets. Tests have established that a significant variety of polymer binder materials, if used with this class of alloys, will cause the product to degrade rapidly, or worse.

One example of a suitable inert binder is an ethylene-vinyl acetate copolymer such as that sold by U.S. Industrial Chemicals under their designation "Ultrathene 634." This has a vinyl acetate content of 28 wt. % and a density of 0.95 gms/cm$^3$. Vinyl acetate-ethylene elastomers are also suitable. One example of the latter is "Vynathene EY 904", which has a vinyl acetate content of 51% and a specific gravity of 0.98. Elastomeric silicone rubbers are also useful. Epoxies, nylon, and polyethylene (PE) also have a practical degree of inertness to NdFeB powder, and may be blended with the foregoing polymers to improve processing characteristics, strength and/or environmental aging and resistance qualities.

In one practice of the invention, a mixture having an intended packing fraction $P_{fi}$ of 0.8027 is prepared from 240.24 grams of Magnequench "MQ" powder and 7.43 grams of "Ultrathene 634" as the binder. The sum total weight $W_t$ of this mixture is 247.67 grams.

The intended packing fraction is:

$$P_{fi} = \frac{(240.24 \times .95)}{(7.43 \times 7.55) + (240.24 \times .95)} = .8027$$

The measured specific gravity of the composite is 6.25. Therefore, the resulting packing fraction is $$P_f = \frac{(240.24 \times .95) + (7.43 \times 7.55)}{(247.67 \times 7.55 \times .95)} \times 6.25 \times .8027 = .803$$

Figure 2:
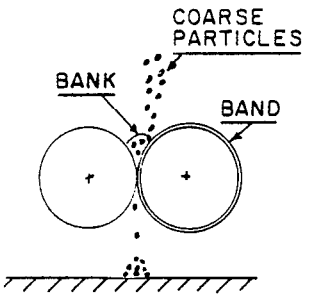
FIG. 2 is a diagrammatic illustration of one procedure for carrying out the initial mixing step of the present method, wherein relatively coarse magnetic particles are added to the binder as it is being worked on a two-roll mill.

The composite was prepared on a two-roll mill having rolls of 3" diameter, set at a spacing just sufficient to form a small bank between them. The binder was first worked into a band on the mill, before any magnet particles were added. During mixing some particles dropped from the rolls of the mill into a collecting pan placed below them (see FIG. 2).

The particles must be added slowly enough to avoid heat build-up and possible sparking due to friction in the presence of air. The relatively coarse magnet particles were sprinkled slowly onto the bank generated by the binder at the nip between the rolls. At first the magnet particles are easily "wetted" by the binder, but as their proportion increases the binder becomes much less receptive and tends to reject further particles. The particles not incorporated by the binder passes between the rolls. Many passes (additions) are required to incorporate all the magnet material into the binder.

The composite goes through a deceptive intermediate stage wherein it appears that the limit of particle loading has already been reached, but in fact it has not. The composite becomes crumbly, flakes and peels from the rolls, and loses coherency. Magnet powder which passes between the rolls without being embedded in the matrix is collected and is readded to the mix, as are pieces of the mixture which fall from the rolls. As the material is mixed and layered upon itself, the spacing between the rolls is gradually increased to accept the increasing thickness of the mixture due to the addition of the particles. Over many successive additions the particles are gradually accepted.

Whereas the starting particles appear relatively coarse and shiny, in the final product the particles impart a very fine grained, uniform luster almost like that of metallic paint. Their average size appears to be much less than half that of the coarse starting particles.

Sheets were formed which were layered on one another and cohered to form a coherent homogeneous body by squeezing between the rolls at a spacing less than the thickness of the layered sheets. These sheets were in turn worked down, relayered and recohered repeatedly during the process, preferably at least nine times. Ultimately a sheet was sized to a finished thickness of 0.181". Cylindrical magnets 0.50" diameter×181" thick were punched from the sheet and magnetized in a magnetizing field ($H_s$) of 35 kGauss.

The resulting permanent magnets were durable and edge-cuttable. They were found to have the following properties:

$B_4$: 6,500 Gauss
$H_c$: 5,600 Oersteads
BH max.: 9 MGOe.

The resultant packing fraction of this composite was 0.803. The slope of the demagnetization curve of the starting material (from the data supplied by the powder manufacturer) was 1.177 and its $B_r$ was 7,620 Gauss. Thus the residual induction of the composite ($B_{rc}$) should at best be no more than:

$$\frac{.803}{(1 - .803)(.177) + 1} \times 7{,}620 = 5{,}913 \text{ Gauss}$$

Figure 4:
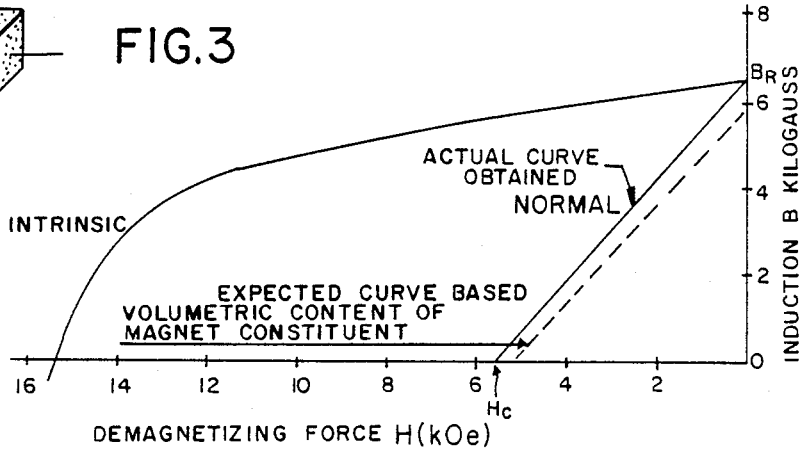
FIG. 4 is a graph of the demagnetization curve of a magnet made in accordance with a preferred embodiment of the invention, and shows how its normal demagnetization curve exceeds that which would be expected.
Figure 5:
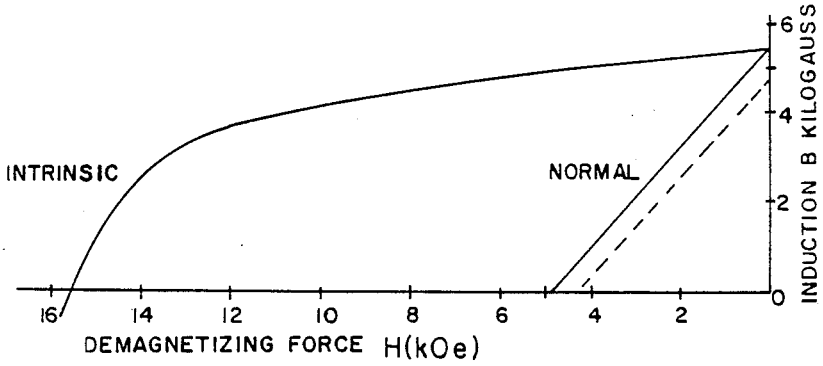
FIG. 5 is a graph similar to FIG. 4 of the demagnetization curve of a magnet made in accordance with a second embodiment of the invention.

As shown in FIG. 4, the actual $B_{rc}$ value obtained for the composite is 6500 gauss, i.e. about 10% in excess of the best value which would be expected. Similarly, the energy product which would be predicted for this composite is 7.7 MGOe; the actual value is about 17% better than the best that would be predicted.

Figure 3:
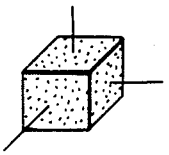
FIG. 3 is a diagrammatic view of the isotropic product permanent magnet of the invention, and shows the comparatively much finer sizes of the particles in it.

Tests demonstrated that the resulting magnets were isotropic, that is, their magnetic properties were virtually equal (within the limits of testing) in each of three mutually perpendicular directions, as designated by the arrows in FIG. 3. Anistropy was not observed or detected; for example, when positioned at random and dropped into a magnetic field, the product magnet did not demonstrate the slightest tendency to align itself in any other direction. This is a simple demonstration of its isotropic nature.

At present we know of no basis to explain the unexpectedly high magnetic properties of this material, other than to say that by all appearances they flow from the particle size reduction.

EXAMPLE 2

Even at smaller packing fractions, $B_{rc}$ still exceeds the value which would be expected. A composite was made with 203 grams of MQ powder and 12 grams of the same binder as in Example 1. The starting magnet material was taken from the same lot described in Example 1. The binder used was that used in Example 1. The sum total weight of this mixture was 215 grams. The composite was prepared according to the procedure used in Example 1 except that mixing proceeded much more rapidly due to the smaller proportion of the particles. The sheets which followed were layered, cohered and worked down in the same manner described in Example 1.

The intended packing fraction is :

$$P_{fi} = \frac{(203 \times .95)}{(12 \times 7.55) + (203 \times .95)} = .680$$

The measured specific gravity of the composite was 5.332. Therefore, the resultant packing fraction is:

$$P_f = \frac{(203 \times .95) + (12 \times 7.55)}{(215 \times 7.55 \times .95)} \times 5.332 \times P_{fi} = .666$$

The properties of the composite were:
$B_r$: 5,500 Gauss
$H_c$: 4,850 Oerstead
BH max.: 6.6 MGOe.

Again, it would be expected that $B_{rc}$ of the composite should be no more than:

$$\frac{.666}{(1 - .666)(.177) + 1} \times 7{,}620 = 4{,}792 \text{ Gauss}$$

Surprisingly, however, the value obtained for the composite was 5,500 Gauss, or 15% in excess of the highest expected value. The energy product of 6.6 MGOe was about 25% better than the predicted value of 5.26.

From the foregoing, those skilled in the art will appreciate that this invention provides a very practical method of making composite magnets of unexpectedly good properties from materials which otherwise can be extremely difficult to use in the production of composite magnets.

Having described the invention, what is claimed is:

1. A process for making bonded magnets of the rare earth type having unexpectedly high magnetic properties, comprising:

adding particles of rare earth type permanent magnet material to a workable non-magnetic binder until the particles are coated with and cohered in the binder as a workable mass; the average size of the particles of the starting magnet material being substantially larger than single domain size for said magnet material, less than about 15 weight % of the particles of said starting material being smaller than 44 microns in size;

thereafter working said mass under shearing forces of such intensity that the average size of the particles is substantially reduced by such working, thereby improving the magnetic properties of the particles, progressively reducing the thickness of said mass during said working while simultaneously increasing its area to form an extended shape therefrom, forming desired magnet shapes from said sheet, and magnetizing said magnet shapes to form permanent magnets therefrom, said magnets having a residual induction which exceeds by at least 5% the maximum value expected for their packing fraction.

2. The process of claim 1 wherein the particles of the starting magnet material are isotropic, and wherein the product is similarly isotropic.

3. The process of claim 1 further wherein the average size of the particles in said mass is reduced by at least 50% during said working.

4. The process of claim 1 wherein particles of said magnet material are added to said binder until the packing fraction of magnet particles in said mass is at least about 0.65.

5. The process of claim 1 wherein said magnet material is a rapidly quenched neodymium-iron-boron permanent magnet alloy.

6. The process of claim 1 wherein said magnets have a maximum energy product of at least 6.0 GaussOerstead.

7. The process of claim 1 wherein said binder is a copolymer of ethylene and vinyl acetate.

8. The process of claim 1 wherein said particles are magnetized before they are added to said binder, thereby minimizing suspension of such particles in air.

9. The process of claim 1 wherein said working is carried out in a screw-type mixer.

10. The process of claim 1 wherein said working is carried out in a two-roll mill.

11. The process of claim 1 wherein the packing fraction is at least 0.65; at least about 85% wt. % of said particles being in the range of 44–420 microns and the residual induction of said permanent magnets is at least 5000 Gauss.

12. The process of claim 11 wherein said mixture is worked into sheets which are then layered and reduced in size, at least nine times.

13. A durable, bonded, edge cuttable isotopic composite permanent magnet comprising particles of permanent magnet material incorporated in a workable binder, said magnet having a measured residual induction $B_{rc}$ which is at least 5% greater than the amount calculated for that magnet from the expression, $$\frac{P_f}{(1 - P_f)(S - 1) + 1} \times B_r$$

where $P_f$ is the particle packing fraction of the composite magnet;

$B_r$ is the measured residual induction of the magnet material;

S is the shope $B_r/H_c$ of the starting material; and $H_c$ is the measured coercity of the magent material, the average size of the particles having been substantially reduced in situ by shear forces exerted on them through the working of coarser starting magnetic particles into the binder.

14. The magnet of claim 13 wherein the residual induction is at least 10% greater than would be predicted from its packing fraction.

15. The magnet of claim 13 having a packing fraction of at least about 0.60.

16. The magnet of claim 13 wherein said permanent magnet material is a rare earth magnet material.

17. The magnet of claim 17 wherein said permanent magnet material is rapidly quenched neodymium-iron-boron.

18. The magnet of claim 18 wherein said particles are of a size so small as to be pyrophoric if not embedded in said binder.

19. The magnet of claim 13 wherein said binder is a copolymer of ethylene and vinyl acetate.

20. The process of claim 1 wherein said binder is a silicone rubber.

21. The magnet of claim 13 wherein said binder is a silicone rubber.

22. The process of claim 1 wherein said binder is a polymer which is chemically compatible with the particles of said magnet material.

23. The magnet of claim 13 wherein said binder is a polymer which is chemically compatible with the particles of said magnet material.

* * * * *